US007466935B2

(12) United States Patent
Stahuber et al.

(10) Patent No.: US 7,466,935 B2
(45) Date of Patent: Dec. 16, 2008

(54) TRANSFERRING AND FIXING SYSTEM AND METHOD USING A GUIDED CONVEYOR SECTION AND A FREE CONVEYOR SECTION

(75) Inventors: Markus Stahuber, Miesbach (DE); Andreas Wirtz, Neubiberg (DE)

(73) Assignee: Oce Printing Systems GmbH, Poing (DE)

( * ) Notice: Subject to any disclaimer, the term of this patent is extended or adjusted under 35 U.S.C. 154(b) by 311 days.

(21) Appl. No.: 10/530,005

(22) PCT Filed: Oct. 10, 2003

(86) PCT No.: PCT/EP03/11262

§ 371 (c)(1),
(2), (4) Date: Sep. 20, 2005

(87) PCT Pub. No.: WO2004/036318

PCT Pub. Date: Apr. 29, 2004

(65) Prior Publication Data

US 2006/0140661 A1 Jun. 29, 2006

(30) Foreign Application Priority Data

Oct. 10, 2002 (DE) ..... 102 47 367

(51) Int. Cl.
*G03G 21/20* (2006.01)
*G03G 15/20* (2006.01)

(52) U.S. Cl. ..... 399/92; 399/312

(58) Field of Classification Search ..... 399/303, 399/312, 320–342
See application file for complete search history.

(56) References Cited

U.S. PATENT DOCUMENTS

| | | | | |
|---|---|---|---|---|
| 4,538,899 | A | 9/1985 | Landa et al. | |
| 5,079,592 | A | 1/1992 | Kanis | |
| 5,130,753 | A | 7/1992 | Nakano et al. | |
| 5,148,224 | A * | 9/1992 | Yamada et al. | 399/312 |
| 5,499,086 | A | 3/1996 | Matsuno et al. | |
| 5,530,535 | A * | 6/1996 | Matsuoka | 399/313 |
| 5,589,923 | A * | 12/1996 | Lee et al. | 399/78 |

(Continued)

FOREIGN PATENT DOCUMENTS

DE 77 36 767 9/1980

(Continued)

OTHER PUBLICATIONS

2003263047 A—Sep. 19, 2003—Fixing Device—Abstract.

*Primary Examiner*—Ryan Gleitz
(74) *Attorney, Agent, or Firm*—Schiff Hardin LLP

(57) ABSTRACT

In a method and system for transfer printing of an electrostatic recharge toner image from an intermediate carrier onto a recording medium and for fixing of the transfer-printed toner image onto the recording medium, the recording medium lying on an electrostatically-chargeable conveyor belt and adhered thereto by electrostatic forces is transported through a transfer printing region and subsequently along a guided transport section. The recording medium is conveyed to a fixing device. The guided transport section is arranged in a transport unit and the fixing device is arranged in a fixing unit which are independent of one another. The fixing unit has at least one wall designed to hinder a heat transfer from the fixing unit to the transport unit.

25 Claims, 7 Drawing Sheets

U.S. PATENT DOCUMENTS

| | | | | |
|---|---|---|---|---|
| 5,655,200 | A * | 8/1997 | Oyama | 399/313 |
| 5,666,622 | A | 9/1997 | Harasawa et al. | |
| 6,212,351 | B1 | 4/2001 | Kawagoe et al. | |
| 6,212,357 | B1 | 4/2001 | Boehmer et al. | |
| 2002/0057933 | A1 | 5/2002 | Ebihara et al. | |
| 2002/0098011 | A1 | 7/2002 | Tumiya et al. | |
| 2003/0005049 | A1 | 1/2003 | Ogawa | |

FOREIGN PATENT DOCUMENTS

| | | | | |
|---|---|---|---|---|
| DE | 40 39 158 | | | 6/1991 |
| DE | 34 06 290 | | | 9/1993 |
| DE | 43 24 148 | | | 4/1997 |
| DE | 199 56 505 | | | 6/2000 |
| EP | 0 425 227 | | | 5/1991 |
| JP | 57189169 | A | * | 11/1982 |
| JP | 58182669 | A | * | 10/1983 |
| JP | 59171977 | A | | 9/1984 |
| JP | 2-50169 | A | | 2/1990 |
| JP | 02148074 | A | * | 6/1990 |
| JP | 02297572 | A | * | 12/1990 |
| JP | 7-84472 | A | | 3/1995 |
| JP | 7-261584 | A | | 10/1995 |
| JP | 08 185 160 | | | 7/1996 |
| JP | 11-231760 | A | | 8/1999 |
| JP | 2000227730 | A | | 8/2000 |
| JP | 2001005321 | A | | 1/2001 |
| JP | 2003263045 | A | | 9/2003 |
| WO | WO 98/18052 | | | 4/1998 |
| WO | WO 98/58297 | | | 12/1998 |

* cited by examiner

TRANSFERRING AND FIXING SYSTEM AND METHOD USING A GUIDED CONVEYOR SECTION AND A FREE CONVEYOR SECTION

BACKGROUND

The disclosed embodiment generally relates to a device and a method for transfer printing of an electrostatically charged toner image from an intermediate carrier of an electrographic printer or copier onto a recording mediums and fixing of the transfer-printed toner image onto the recording medium.

In electrographic printers or copiers, the transfer of a toner image from an intermediate carrier (for example a photoconductor drum or a photoconductor ribbon) onto a recording medium is designated as transfer printing. The section of the printing or copying device at which the intermediate carrier and the recording medium are brought into contact with one another is designated as a transfer printing region. In the transfer printing region, the intermediate carrier (meaning, for example, the generated surface of a photoconductor drum) and the recording medium move in the same direction with the same speed, while the toner is transferred from the intermediate carrier onto the recording medium. A print image of high quality can only be achieved on the recording medium when a uniform contact between recording medium and intermediate carrier is produced in the transfer printing region and when the recording medium and the intermediate carrier actually move with exactly the same speed in the transfer printing region.

In known printing or copying devices, the recording media are transported with transport rollers in the transfer printing region and effected on the side facing away from the intermediate carrier with a charge whose polarity sign is opposite to the charge of the toner image and of the intermediate carrier. The recording medium is thereby attracted by the intermediate carrier and transported through the transfer printing region adhering to this; at the same time the charge of the recording medium effects the transfer of the charged toner particles from the intermediate carrier onto the recording medium. Upon leaving the transfer printing region, the recording medium is then discharged with the aid of a discharge device with which it is loosened from the intermediate carrier and transported to a fixing device.

A transfer printing device of this type is known from WO 98/58297 A1. This transfer printing device has a contact element to press the recording medium onto the intermediate carrier. From WO 98/18052, a printer is known with two similar printing groups to which recording media are supplied via an input section. The printed recording medium are output via a common output section. An outlet channel is associated with the one printing group, via which outlet channel the recording media that have been printed on one side by this printing group can be re-supplied to this printing group for printing of the back side. A recording medium printed by the other printing group can be removed via the outlet channel to the output section by bypassing the transfer printing transport path of the first-cited printing group.

Further prior art is to be learned from the documents DE 199 56 505 A1, DE 43 24 148 C2, U.S. Pat. No. 5,666,622 A, US 2002/057933 A1, DE 40 39 158 A1, JP 2002-268 301 A, DE 77 36 767 U1 and DE 34 06 290 C2.

During the transport of a recording medium from the transfer printing region to the fixing device, its printed side may not be contacted because the not-yet-fixed toner image would otherwise be smeared. In conventional devices for transport of the printed recording medium, a vacuum table is therefore typically used in which the recording medium is held on a transport ribbon via suction pressure. In the fixing device, the recording medium is guided between two rollers whose generated surfaces abut closely to one another along a surface line and form a roller contact region or transport gap. The roller contact region or transport gap is also often designated in the German literature with the English term "nip". Of the two rollers at least one is heated, and the toner image is affixed on the recording medium via pressure and heat.

Upon entrance of the recording medium into the roller contact region, the fixing rollers perform an additional milling task, whereby the recording medium is temporarily braked (this experiences a sudden jarring) that is in the direction opposite the transport direction. The distance between fixing rollers and transfer printing region is often less than the length of the longest recording medium to be printed in compactly designed printers or copying devices and in particular in devices with two printing groups. By the "length" of the recording medium, what is always meant in the following is the dimension of the recording medium in the transport direction, thus the length of the edges of the recording medium that are arranged parallel to the transport path. Given a rectangular recording medium, these do not necessary have to be the "lengthwise edges", but rather can also be its transverse edges, namely when it is printed in the landscape format.

When the distance between the transfer printing region and the fixing rollers is shorter than the length of the recording medium, it can occur that the leading edge of the recording medium experiences a jarring in the roller contact region while the recording medium is still being printed at a rear section. In the event that this jarring transfer to the rear section, this leads to a smearing of the print image which is unacceptable.

SUMMARY

It is an object to specify a device and a method with which a print image of high quality can be generated given a compact design.

In a method and system for transfer printing of an electrostatic recharge toner image from an intermediate carrier onto a recording medium and for fixing of the transfer-printed toner image onto the recording medium, the recording medium lying on an electrostatically-chargeable conveyor belt and adhered thereto by electrostatic forces is transported through a transfer printing region and subsequently along a guided transport section. The recording medium is conveyed to a fixing device. The guided transport section is arranged in a transport unit and the fixing device is arranged in a fixing unit which are independent of one another. The fixing unit has at least one wall designed to hinder a heat transfer from the fixing unit to the transport unit.

DESCRIPTION OF THE PREFERRED EMBODIMENT

Figure 1:
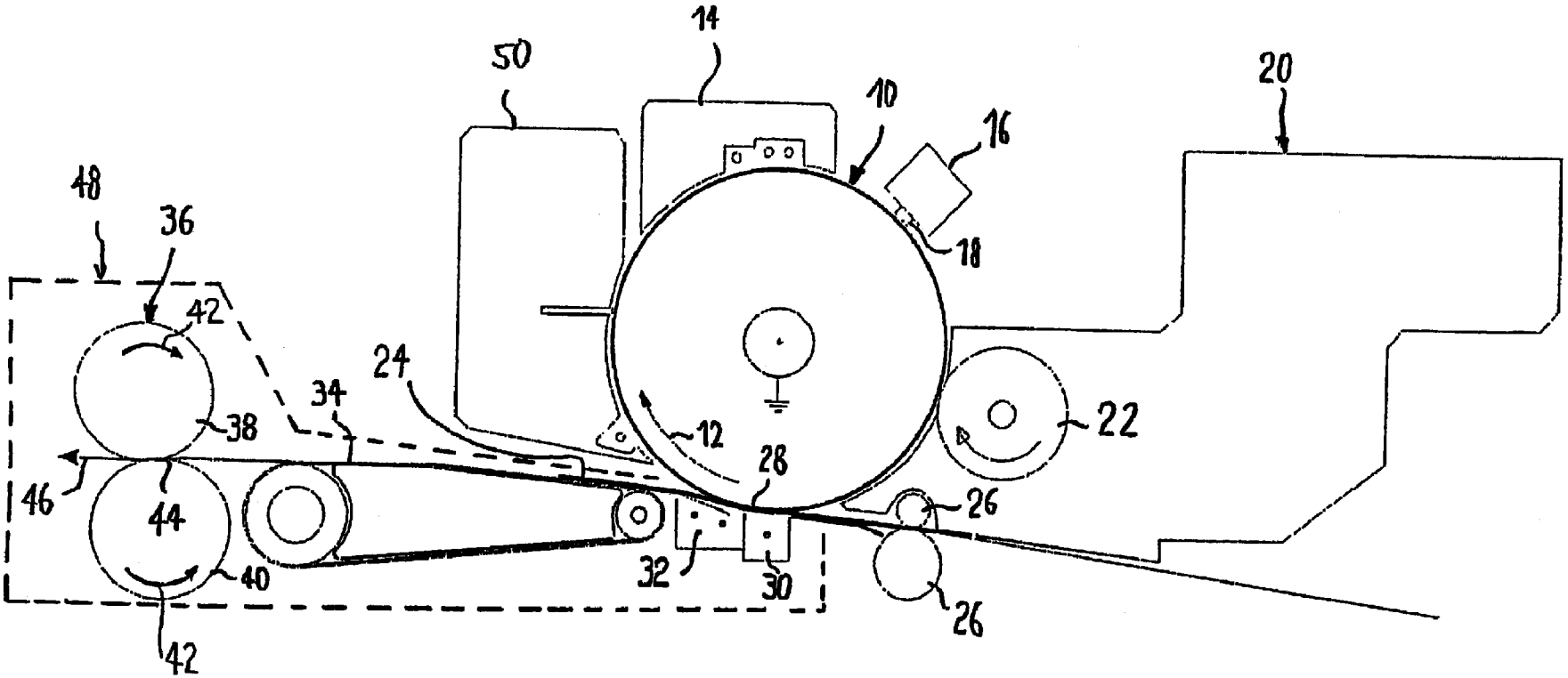
Fig. 1 (PRIOR ART)
FIG. 1 is a schematic representation of the components of an electrographic printing or copying device participating in the image generation, with a conventional device for transfer printing of a toner image from an intermediate carrier onto a recording medium and fixing of the transfer-printed toner image onto the recording medium.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A compact design of the device inevitably leads to a small distance between transport ribbon and the fixing device. Due to the spatial proximity, the conveyor belt is likewise heated by the heat necessary for fixing, whereby it can deform and thereby be impaired with regard to its function. Moreover, given heating of the conveyor belt the danger exists that toner located on it begins to melt and adheres on the conveyor belt.

The guided transport section is arranged in the preferred embodiment in a transport unit and the fixing device is arranged in the preferred embodiment in a fixing unit that are used independently of one another in the printer or copier and can be removed from these. Via the structural separation of the two units, no heat can be transferred over common components, for example circuit boards.

The fixing unit thus has a wall designed as a hollow chamber profile that offers a good heat insulation. In a particularly advantageous development, the hollow chamber profile has openings through which air can be drawn for cooling of the transport unit.

In the device and a method according to an advantageous development of the preferred embodiment, the recording medium lying on an electrostatically chargeable conveyor belt and adhered to this via electrostatic forces is transported along a subsequent guided transport section and conveyed, via a free transport section (subsequent to the guided transport section) in which the recording medium can freely arch, to a fixing device in which the recording medium is again guided in a fixed manner.

A "free transport section" designates in this document a transport section on which the recording medium is freely arched, and thus can form a wave or a buckle, whereby the distance between its front and rear edge is shortened. By forming an arch or wave, the shock that is exerted on its front edge upon entry of the recording medium into the roller contact region of the fixing roller can be absorbed.

The developed device or method thus effectively prevents a smearing of the print image. On the one hand, a stronger adhesion can be achieved with the aid of an electrostatically-chargeable conveyor belt than with a vacuum table, such that the section of the recording medium located in the guided transport section can be not-so-lightly braked by the shock. On the other hand, the shock can be absorbed by the possibility for wave formation in the free transport section.

A secure guidance of the recording medium in the guided transport section assumes a sufficient electrostatic charge of the conveyor belt that is maintained over the entire length of the guided transport section. The conveyor belt therefore preferably has a specific volume resistance of between $10^{11}$ and $10^{15}$ Ω cm. In a particularly advantageous embodiment, the conveyor belt is significantly comprised of polyvinylidenfluoride (PVDF).

In spite of a compact design, the guided transport section must be long enough to ensure a sufficiently safe guidance that precludes a smearing of the print image in the transfer printing region. The length $L_1$ of the guided transport section is preferably between 100 and 210 mm.

The length $L_2$ of the free transport section must be large enough that a wave with a not-too-slight curvature can form to absorb the shock. $L_2$ is preferably ⅓ of the length of the shortest recording medium to be printed. A good wave formation results given a length of $L_2$ between 80 and 130 mm.

The components of an electrographic printer participating in the image generation are schematically shown in FIG. 1. The main features of the electrographic printing or copying are explained briefly with regard to these in the following.

A photoconductor drum 10 is shown in cross-section in FIG. 1 whose peripheral area is coated with a photosemiconductor, for example arsentriselenide ($As_2Se_3$). Such a photosemiconductor has a high dark resistance that, however, decreases given sufficient exposure. The photoconductor drum 10 rotates in the direction indicated with the arrow 12. Its photoconductor layer is thereby initially electrostatically charged with the aid of what is known as a charge corotron 14. Via rotation of the photoconductor drum 10, the charged section arrives at a character generator 16 with a light source 18 (an LED comb in FIG. 1) with which the photoconductor drum 10 is exposed. The electrical resistance of the photoconductor drum layer drops at the exposed locations and the charge discharges. Image points of a latent charge image are thus generated on the photoconductor drum.

Given a further rotation of the photoconductor drum 10, the latent charge image arrives at a developer station 20 from which triboelectrically-charged toner is transferred (with the aid of a suitable electrical field) from a developer roller 22 onto the exposed locations (what is known as "dark writing") or unexposed locations (what is known as "light writing") of the photosemiconductor. The charge image located on the photoconductor drum 10 is thus inked with toner, i.e. developed. The toner image is subsequently transferred onto a recording medium, for example a sheet of paper 24. The photoconductor drum 10 is therefore generally designated as an intermediate carrier.

The sheet 24 is transported into the transfer printing region 28 with the aid of transport rollers 26. The section at which the photoconductor drum 10 and the sheet 24 come in contact with one another and the toner image is transferred onto the sheet 24 is designated with "transfer printing region". In the conventional device shown in FIG. 1 for transfer of the toner image from the photoconductor drum 10 onto the sheet 24, the latter is sprayed (with the help of what is known as a transfer corotron 30) on its underside with charge that is opposite to the charge of the toner. The sheet 24 thereby adheres to the photoconductor drum 10 and the toner is transferred onto the sheet 24 via the electrostatic adhesion.

To separate the sheet 24 from the photoconductor drum 10, it is subsequently discharged again with the aid of an alternating current corotron 32, such that the electrostatic adhesion forces disappear and the sheet 24 shears from the photoconductor drum 10 due to its rigidity. The printed sheet 24 is then transported into a fixing device 3 via a vacuum table 34. Toner remaining on the photoconductor drum 10 after the transfer printing is removed by a cleaning unit 50.

The fixing device 36 has two rollers, a heated fixing roller 38 and a pressure roller 40 that presses against the fixing roller 38 and, with this, forms a roller contact region 44. The rollers 38 and 40 rotate in a direction (characterized with arrows 42) with a circumferential velocity $v_f$. For fixing, the sheet is guided along the transport path 46 through the roller contact region 44. All components participating in transfer printing and fixing are situated in a common structural unit 48.

The device from FIG. 1 is kept so compact that the distance between transfer printing region 28 and fixing device 36 is smaller than the length of the longest recording medium to be printed. This means that the leading edge of such a recording medium already enters into the roller contact region 44 while a rear section of the same is still being printed in the transfer printing region 48.

Figure 2:
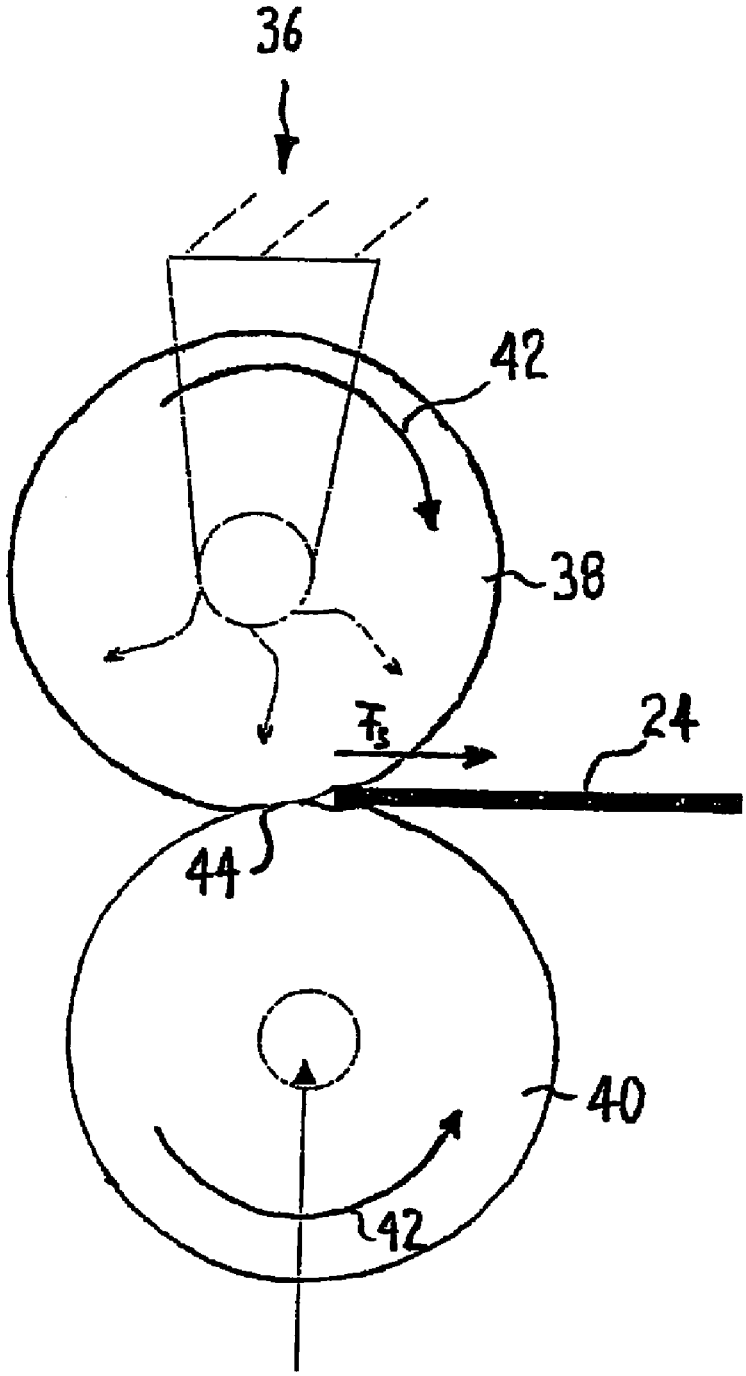
Fig. 2 (PRIOR ART)
FIG. 2 is a schematic representation of a recording medium given entrance into the roller contact region of two fixing rollers.

In FIG. 2, the fixing device 36 is shown in which the leading edge of the recording medium 24 enters into the roller contact region 44 formed by the fixing roller 38 and the pressure roller 40. As is to be seen in FIG. 2, the rollers 38 and 40 are thereby deformed. Upon entering into the roller contact region 44, the leading edge of the sheet is temporarily braked and experiences a shock with an impact force $F_s$. The impact force $F_s$ is opposite to the movement direction of the sheet 24 and is represented in FIG. 2 by a force arrow.

Figure 3:
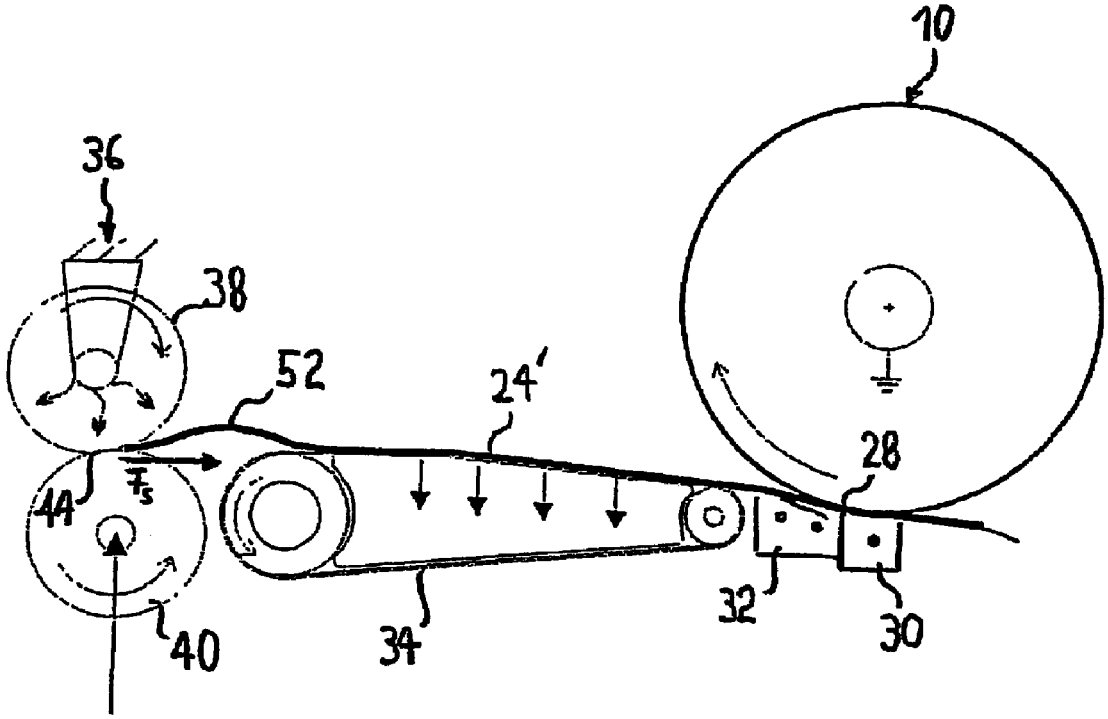
Fig. 3 (PRIOR ART)
FIG. 3 shows the device for transfer printing and fixing from FIG. 1 with a recording medium with low rigidity.

In FIG. 3, for reasons of clarity only those components of the conventional arrangement of FIG. 1 are shown that are participating in the transfer printing and the fixing. Furthermore, a sheet 24' is shown in FIG. 3 whose leading edge directly enters into the roller contact region 44 of the rollers 38 and 40 and thus experiences the impact force $F_s$ just described while a rear section of the sheet 24' is still located in the transfer printing region 28.

In the snapshot shown in FIG. 3, the impact force $F_s$ leads to formation of a wave 52 in the sheet 24'. In this context, what is meant with "wave" is a curved section of the sheet 24' that deviates from the actual provided transport path. The sheet 24' of FIG. 3 has lower rigidity, such that only a slight force is required in order to curve the sheet into a wave 52. Moreover, the tendency of the sheet 24' to shear away from the vacuum table 34 upon formation of the wave 34 is low due to the low rigidity of the sheet 24'. The suction force of the vacuum table 34, which is shown in FIG. 3 by the arrow pointing perpendicularly downwards, is sufficient to prevent a shearing of the sheet 24' from the vacuum table 34. The rear section of the sheet 24' is thus guided on the vacuum table and the impact force $F_s$ is not transferred until the transfer printing region.

Figure 4:
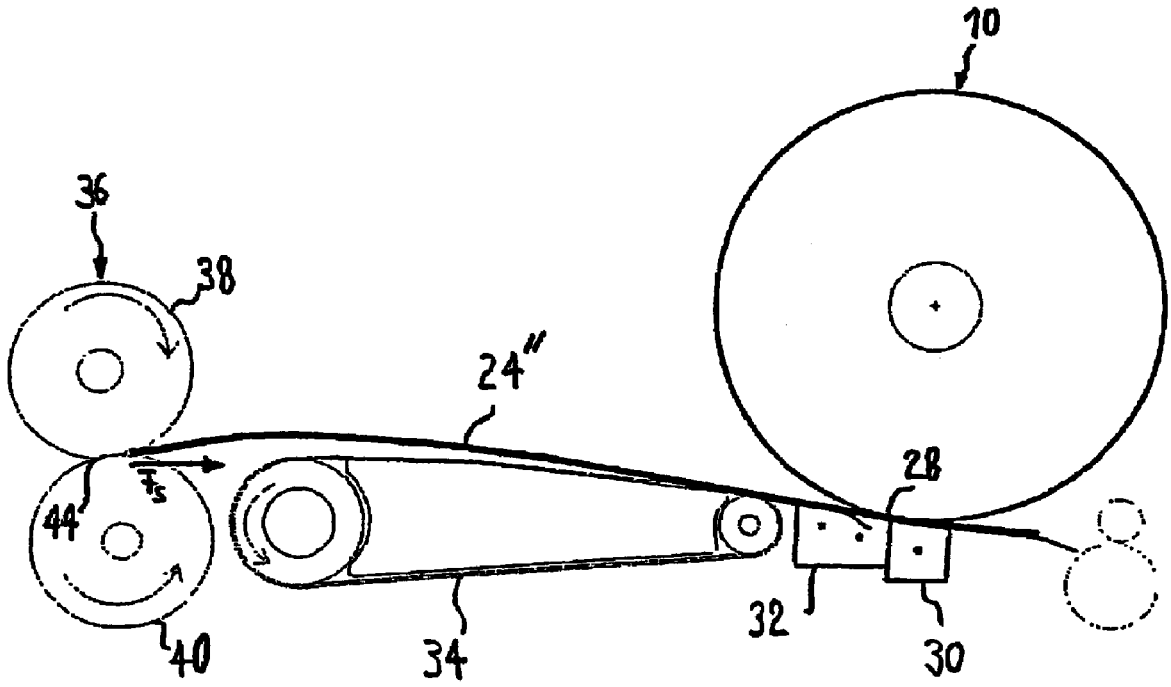
Fig. 4 (PRIOR ART)
FIG. 4 shows the device for transfer printing and fixing from FIG. 1 with a recording medium with high rigidity.

The same components are shown in FIG. 4 as in FIG. 3, only in FIG. 4 a sheet 24' with a higher rigidity is transported. Due to the higher rigidity of the sheet 24", in the representation of FIG. 4 no wave is formed; instead of this the sheet 24" shears from the vacuum table 34. The sheet 24" is nearly stretched, such that the impact force $F_s$ is transferred up to the transfer printing region 28, whereby the print image is smeared.

The specified problem of the print image smearing can only be avoided with great additional effort in the conventional device of FIGS. 1, 3 and 4. For example, the shock can be largely attenuated via a suitable speed control of the fixing rollers 38 and 40 that is triggered by the infeed of the leading sheet edge into the roller arrangement. However, the control must account for the thickness of the paper on which the impact force $F_s$ is dependent. This requires an elaborate sensor technology with a corresponding regulation device. Given sheets with high inherent rigidity and large thickness, a print image smearing cannot be completely prevented even with such a controller. In this case, the pressure force of the rollers upon entrance of the leading sheet edge into the roller contact region 44 must be temporarily reduced, which in turn requires a high mechanical effort and additionally impairs the fixing quality in the region of the leading edge.

Figure 5:
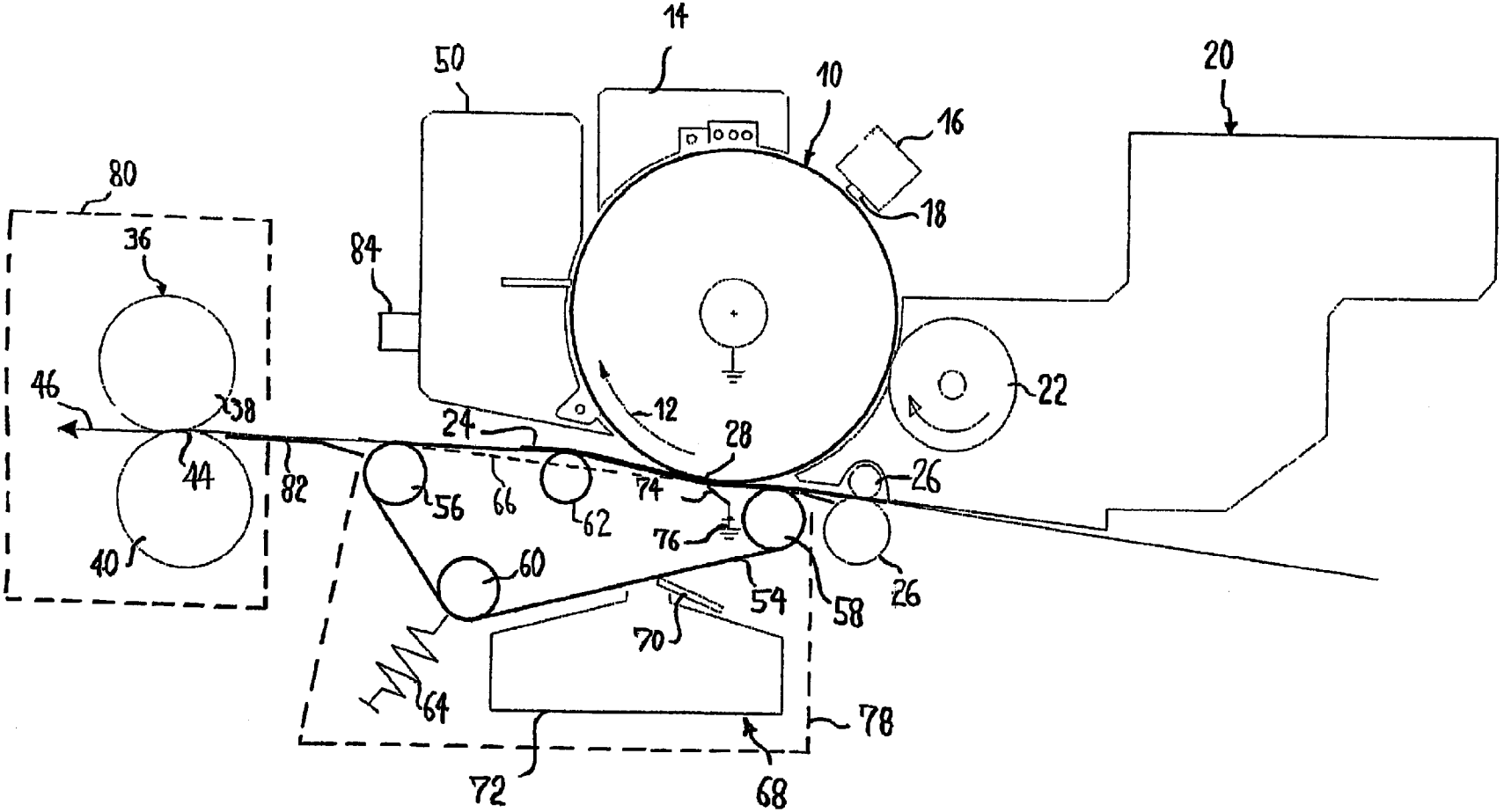
FIG. 5 is a schematic representation of the components of an electrographic printing or copying device participating in the image generation, with a device for transfer printing of a toner image from an intermediate carrier onto a recording medium and fixing of the transfer-printed toner image onto the recording medium.

An arrangement of components participating in the image generation that is identical in significant parts is schematically shown in FIG. 5 as in FIG. 1, in which is shown, however, a device for transfer printing and fixing according to a development of the preferred embodiment. The device has a transport ribbon 54 that is guided around a first roller 56, a second roller 58, a third roller 60 and a positioning roller 62. In the representation of FIG. 5, the conveyor belt 54 is driven counterclockwise by the first roller 56 with a circumferential speed $v_0$ that coincides with the tangential speed of the generated surface of the photoconductor drum 10. The third roller 60 is pre-stressed with a spring 64, such that it exerts a tensile stress on the conveyor belt 54. The positioning roller 62 is arranged between the first roller 56 and the transfer printing region 28 and positions the conveyor belt 54 outwards relative to an alignment 66 of the first and second roller 56, 58. The positioning roller 62 provides for a narrow arrangement of the conveyor belt 54 on the photoconductor drum 10, in that the conveyor belt loops around the photoconductor drum in the transfer printing region, i.e. contacts the generated surface of the photoconductor drum over a certain angle range.

A cleaning device 68 is arranged below the conveyor belt 54. The cleaning device 68 has a blade 70 that is arranged transverse to the running direction of the conveyor belt 54 and is arranged abutting this and a toner capture reservoir 72 into which toner abraded from the conveyor belt 54 by the blade 70 falls.

A blade-like element 74 that is connected with a voltage source 76 (schematically shown) and serves to charge the transport ribbon 54 abuts on the side of the conveyor belt 54 facing away from the photoconductor drum 10. The conveyor belt 54 with the associated rollers 56, 58, 60 and 62, the cleaning device 68, and the contact blade 74 are structurally integrated into a transport unit 78 that is represented by a framework shown dashed in the schematic representation of FIG. 5.

In FIG. 5, a fixing device 36 is shown that does not significantly differ from those of FIGS. 1, 3 and 4, however is integrated into a structurally independent fixing unit 80 that is likewise schematically shown by a framework shown in dashed lines. A guide plate 82 also belongs to the fixing unit 80. A discharge device 84 is arranged above the first roller 56.

The function of the device is explained in detail in the following with reference to FIG. 5. The conveyor belt 54 is charged via the contact blade 74 to an electrostatic potential of some kilovolts relative to a ground potential, whereby the polarity sign of the charge of the conveyor belt 54 is different from the polarity sign of the charge of the toner image on the photoconductor drum 10. A recording medium 24 is conveyed onto the conveyor belt 54 with the aid of transport rollers 26 in the region of the second roller 58 and electrostatically adheres to this transport band 54. In the transfer printing region, the conveyor belt 54 loops around the photoconductor drum 10 at a certain angle range and thereby produces a uniform contact between the sheet 24 lying on the conveyor belt 54 (and adhering thereto) and the photoconductor drum 10.

The conveyor belt 54 has a specific volume resistance between $10^{11}$ and $10^{15}$ Ωcm, such that the section between the first roller 56 and the transfer printing region 28 retains a sufficient electrostatic charge in order to hold the sheet 24 on it via electrostatic forces. The transport path between the transfer printing region 28 and the first roller 56 is therefore called a "guided transport section" in the following. A particularly good guidance results given a conveyor belt that is significantly comprised of polyvinylidenfluoride (PVDF), has a specific volume resistance of $8\times10^{12}$ Ωcm and a thickness of 150 μm.

The first roller 56 is an antistatic roller made from silicon with a specific volume resistance of $10^8$ Ωcm and is therefore suited to dissipate a larger part of the charge of the conveyor belt 54 away from this at the end of the guided transport section. The first roller 56 has a diameter of less than 28 mm, such that the conveyor belt 54 is relatively significantly curved on said roller 56 and the sheet 24 easily shears from the conveyor belt 54 guided around the first roller 56.

Depending on the charge strength and composition of the conveyor belt 54, it can be advantageous to already have dissipated a certain charge quantity from the conveyor belt 54 at the positioning roller 62. The quantity of the charge dissipated at the drawing roller can be influenced by its material, for example the choice between metal and plastic.

During the guided transport section, the transfer-printed but not-yet-fixed toner is held on the sheet 24 by the electrostatic attraction of the conveyor belt 54. After the shearing of the sheet 24 from the conveyor belt 54 in the region of the first roller 56, this attraction is lacking and the similarly-charged toner particles tend to repel one another and accumulate in conductive parts located in the surroundings and contaminate these. In order to prevent this, upon shearing of the sheet 24 from the conveyor belt 54, the toner located on the sheet 24 is discharged with the aid of the discharge device 84.

The sheet sheared from the transport ribbon 24 is guided over the guide plate 82 into the fixing unit 80 and there is fixed. Outside of gravity, no forces affect the sheet 24 between the first roller 56 and the roller contact region 44. This section is therefore called a free transport section in the following. In the free transport section, the sheet 24 has the possibility to form a wave, and thus to absorb the described impact force $F_s$.

Figure 6:
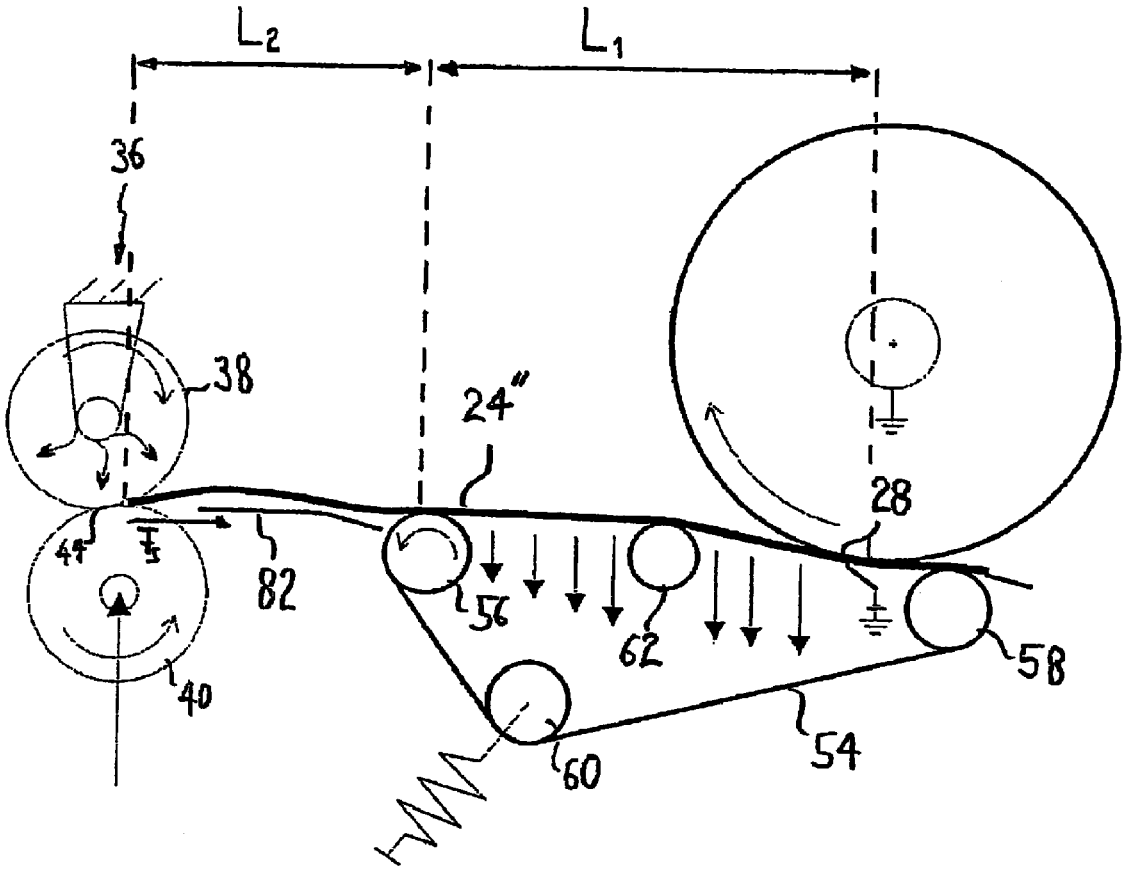
FIG. 6 shows the device for transfer printing and fixing from FIG. 5 with a recording medium with high rigidity.

FIG. 6 is a snapshot in which the leading edge of a sheet 24" enters in the roller contact region 44 while a rear section of the sheet 24" is still being printed in the transfer printing region 28. Although the sheet 24" is the same sheet as in FIG. 4, here the shock is not transferred into the transfer printing region 28; rather, the sheet 24" remains adhered to the conveyor belt 54 in the guided transport section while a wave forms in the free transport section.

Two reasons can be cited for the better behavior in the device of FIG. 6 relative to the device of FIG. 4. On the one hand, with the conveyor belt 54 presented here a clearly higher adhesion force of the sheet 24" to the conveyor belt 54 can be achieved than with a vacuum table. The adhesion forces between the sheet 24" and the conveyor belt 54 are represented in FIG. 6 by the vertical force arrows pointing downwards. The adhesion force in the direction of the first roller 56 does in fact decrease with the charge density in the conveyor belt 54, but even in the proximity of the first roller 56 it is large enough in order to prevent a shearing of the sheet 24". Even if the wave should project somewhat into the guided transport section, the safe guidance in the transfer printing region is not impaired since, first, the impact force abates with the propagation of the wave and, second, the adhesion force of the sheet 24" to the conveyor belt 54 increases in the direction of the transfer printing region 28.

On the other hand, the free transport section in which the wave can form is clearly larger than the free section in the device of FIGS. 3 and 4, such that a flatter wave can form that has a lesser tendency to shear from the conveyor belt 54 than a more significantly curved wave.

In FIG. 6, the length of the guided transport section is designated with $L_1$ and the length of the free transport section is designated with $L_2$. Given a compact design, a certain, optimally smaller distance is aimed for between the transfer printing region and the fixing device, i.e. a certain value for the sum of $L_1$ and $L_2$. A larger value for $L_1$, i.e. a longer guided transport section, has the advantage that the total retention force that the sheet 24" experiences is relatively large. However, a larger value for $L_2$ has the advantage that a flatter wave can form, such that the shear forces are less. Given a desired value for $L_1+L_2$, an optimally ideal compromise must thus be found between $L_1$ and $L_2$.

However, by comparison with FIGS. 3 and 4, it is immediately clear that as good a behavior never results with the conventional device with a likewise compact design (i.e. with an equal distance between transfer printing region 28 and fixing device 36) as with the device of FIGS. 5 and 6. In the device from FIGS. 3 and 4, the guided region does not already begin in the transfer printing region 28 because the sheet 24' or 24" must be discharged in direct connection with the transfer printing so that it loosens from the photoconductor drum 10. Since the discharge requires some time, however, at the same time a high process speed is sought, and the belt discharge region cannot be selected significantly shorter than as shown in FIGS. 3 and 4. The belt discharge region is thus lost, both for the retention of the sheet 24' or 24", and for the wave formation.

A secure guidance of the sheet 24" in the proximity of the transfer printing region 28 directly contributes to preventing a print image smearing. In the device from FIGS. 5 and 6, the retention force of the sheet 24" on the conveyor belt 54 is strongest in proximity to the transfer printing region 28, while in the device from FIGS. 3 and 4, the sheet 24' or 24" is not guided at all in proximity to the transfer printing region 28 because it still has to be discharged.

In order to achieve a secure guidance of the sheet, the length $L_1$ in FIG. 6 should amount to at least ⅓ of the length of the shortest sheet to be printed. By length, what is thereby meant is the dimension of the sheet in the transport direction, which can also by all means correspond to the shorter side given a rectangular sheet, namely when it is printed in portrait format. In the device from FIGS. 5 and 6, a secure guidance has resulted without print image smearing given lengths of $L_1$ that are between 100 and 210 mm. The length $L_2$ may not be longer than the length of the shortest sheet to be printed (because otherwise this would not be guided at all in stretches) and should amount to at least ⅓ of the length of the shortest sheet to be printed so that a sufficiently flat wave can form.

An advantageous wave formation can be supported via suitable selection of the speed $v_f$ with which the sheet 24" is guided by rollers 38, 40 of the fixing device. $v_f$ is preferably between 97% and 100% of the rotational speed $v_0$ of the conveyor belt 54.

Figure 7:
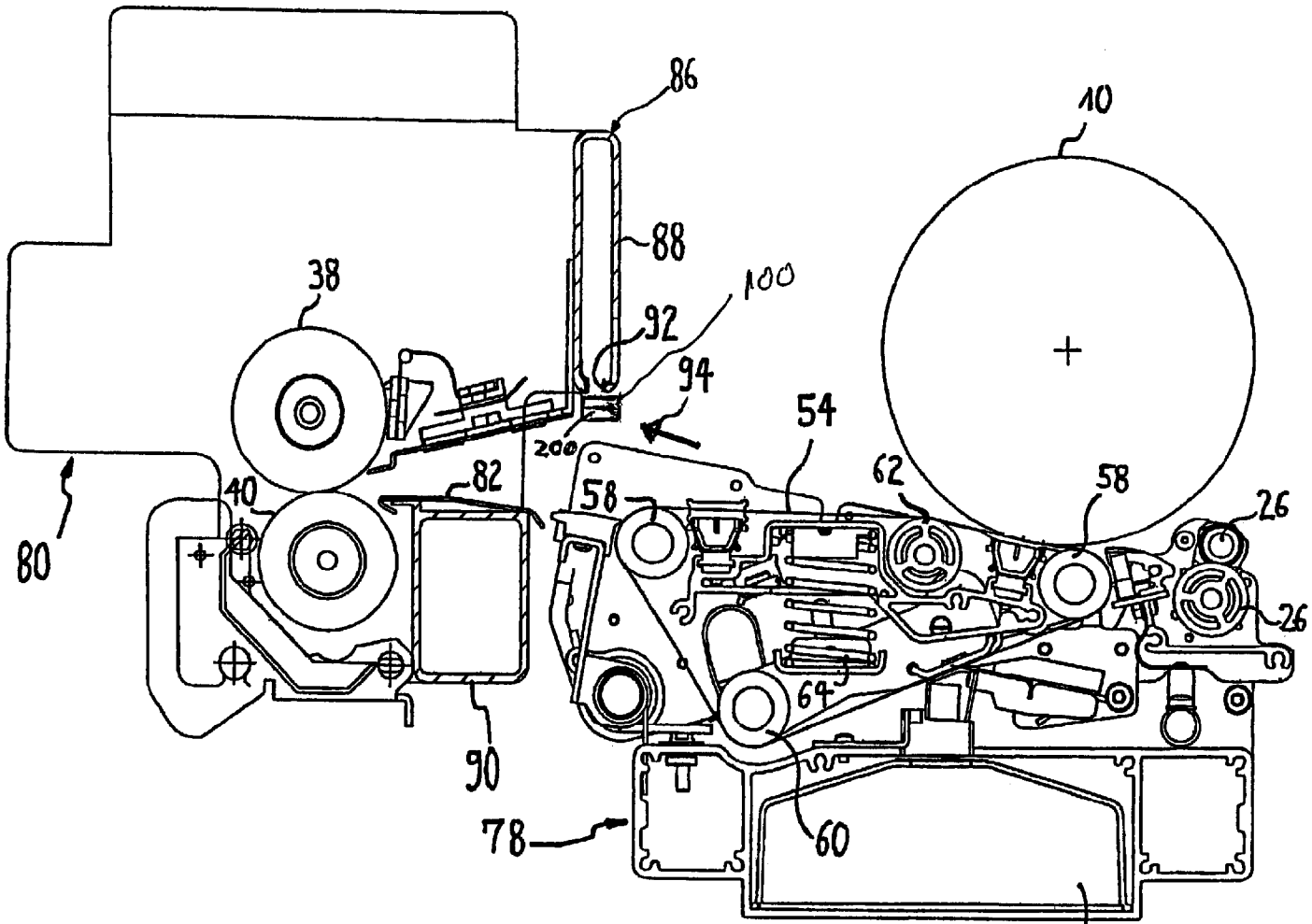
FIG. 7 is a section view of a transport unit and a fixing unit.

The transport unit 78 and the fixing unit 90 are shown in a section representation in FIG. 7. The use of two separate structural units has two large advantages. The one concerns the assembly, which is clearly less elaborates, with separate structural units. The transport unit 78 must be very precisely adjusted relative to the photoconductor drum 10 in order to ensure a good transfer printing, while the fixing unit 80 does not have to be installed with such precision. When the devices for transport and for fixing are combined in one common structural unit, as is the case with the structural unit 48 of FIG. 1, the entire structural unit must be installed with high precision in order to ensure a transfer printing of high quality. However, since just the fixing device contains heavy components, the entire structural unit 48 is much heavier and more unwieldy than the transport unit 78, and therefore also clearly more difficult to precisely install.

The second advantage is that the heat radiated by the fixing roller 38 does not so significantly heat the transport ribbon as would be the case if the conveyor belt 54 and the fixing device 36 were arranged in a common structural unit. This is of the highest importance since the conveyor belt 54 is deformed and loses its functionality due to too-great heating.

The fixing unit 80 has a housing 86 that retains the heat radiated by the fixing roller 38. In the side facing the transport unit 78, the housing 86 has walls 88 and 90 that are designed as hollow chamber profiles and therefore are good thermal insulators. The hollow chamber profile 88 is aerated with a fan 200 and has at least one opening 92 through which air is drawn to cool the transport unit. The air current of the drawn-in air is schematically represented by an arrow 94. In addition to the cooling of the transport unit, the air intake also serves for cleaning of the transport unit of deposited toner particles.

The transport unit 78 and the fixing unit 80 can be advantageously designed as plug-in modules.

The air taken up into the hollow chamber profile is filtered with the aid of an ozone filter 100 before it is dissipated into the surroundings. In the illustrated embodiment, the fan 200 runs for approximately a half-hour after the deactivation of the printer.

Although a preferred exemplary embodiment is shown and specified in detail in the drawings and the preceding specification, these should be viewed as purely exemplary and not as limiting the invention. It is noted in this regard that only the preferred exemplary embodiment is shown and specified, and all variations and modifications should be protected that presently or in the future lie within the scope of protection of the invention.

We claim as our invention:

1. A system for transfer printing of an electrostatically charged toner image in an electrographic printing or copying device, comprising:

an intermediate carrier with an electrostatically charged toner image thereon which transfers the toner image onto a recording medium at a transfer printing region;

the recording medium lying on an electrostatically-chargeable conveyor belt and adhering thereto due to electrostatic forces and which transports the recording medium through said transfer printing region and along a guided transport section where it is conveyed to a fixing device;

said guided transport section being arranged in a transport unit and the fixing device being arranged in a fixing unit, said transport unit and fixing unit being used independent of one another and removable from the printing or copying device;

said fixing unit having at least one wall designed as a hollow chamber profile which hinders a heat transfer from the fixing unit to the transport unit;

the recoding medium being conveyed to the fixing device along a free transport section in which the recoding medium can freely arch; and a length of the free transport section being at least ⅓ of a shortest recording medium to be printed and being shorter than a length of the shortest recording medium to be printed.

2. A system according to claim 1 in which the hollow chamber profile has an opening through which air is drawn to cool the transport unit.

3. A system according to claim 2 wherein the opening in the hollow chamber profile is arranged such that the air is taken up into the hollow chamber profile from an environment of the conveyor belt.

4. A system according to claim 1 in which the conveyor belt comprises a plastic belt with a specific volume resistance of between $10^{11}$ and $10^{15}$ Ω cm.

5. A system according to claim 4 in which the conveyor belt is essentially comprised of polyvinylidenfluoride.

6. A system according to claim 1 in which a length of the guided transport section is at least ⅓ a length of a shortest recording medium to be printed.

7. A system according to claim 1 in which a length of the guided transport section is between 100 mm and 210 mm.

8. A system according to claim 1 in which a length of the free transport section is between 80 mm and 130 mm.

9. A system according to claim 1 in which a speed with which the recording medium is conveyed through the fixing device is between 97% and 100% of a speed with which the recording medium is transported in the guided transport section.

10. A system according to claim 1 with a discharge device to discharge toner located on the recording medium.

11. A method for transfer printing of an electrostatically charged toner image from an intermediate carrier of an electrographic printing or copying device onto a recording medium and for fixing of the transfer-printed toner image onto the recording medium, comprising the steps of:

transporting the recording medium lying on an electrostatically-chargeable conveyor belt and adhering thereto due to electrostatic forces through a transfer printing region and subsequently along a guided transport section;

conveying the recording medium to a fixing device, the recording medium being conveyed to the fixing device along a free transport section in which the recording medium can freely arch, a length of the free transport section being at least ⅓ of a shortest recording medium to be printed and being shorter than a length of the shortest recording medium to be printed; and arranging the guided transport section in a transport unit and arranging the fixing device in a fixing unit used independent of one another in the printing or copying device and which are removable, the fixing unit having at least one wall designed as a hollow chamber profile and which hinders a heat transfer from the fixing unit to the transport unit.

12. A method according to claim 11 in which the hollow chamber profile has an opening through which air is drawn to cool the transport unit.

13. A method according to claim 12 in which the air which is taken up into the hollow chamber profile is from an environment of the conveyor belt.

14. A method according to claim 12 in which the air which is taken up into the hollow chamber profile is filtered with an ozone filter.

15. A method according to claim 11 in which the conveyor belt is essentially comprised of polyvinylidenfluoride.

16. A method according to claim 11 in which a length of the guided transport section is at least ⅓ of a length of a shortest recording medium to be printed.

17. A method according to claim 11 in which a length of the guided transport section is between 100 mm and 210 mm.

18. A method according to claim 11 in which a length of the free transport section is between 80 mm and 130 mm.

19. A method according to claim 11 in which a speed with which the recording medium is conveyed through the fixing device is between 97% and 100% of a speed with which the recording medium is transported in the guided transport section.

20. A method according to claim 11 in which toner located on the recording medium is discharged with aid of a discharge device.

21. A method for transfer printing of an electrostatically charged toner image from an intermediate carrier of an electrographic printing or copying device onto a recording medium and for fixing of the transfer-printed toner image onto the recording medium, comprising the steps of:

transporting the recording medium lying on an electrostatically chargeable conveyor belt and adhering thereto due to electrostatic forces through a transfer-printing region and subsequently along a guided transport section;

conveying the recording medium to a fixing device, the recording medium being conveyed to the fixing device along a free transport section in which the recording medium can freely arch, a length of the free transport section being between 80 mm and 130 mm; and arranging the guided transport section in a transport unit and arranging the fixing device in a fixing unit, independent of one another in the printing or copying device, the fixing unit having at least one wall designed to hinder a heat transfer from the fixing unit to the transport unit.

22. A system for transfer printing of an electrostatically charged toner image in an electrographic printing or copying device, comprising:

an intermediate carrier with an electrostatically charged toner image thereon which transfers the toner image onto a recording medium at a transfer printing region;

the recording medium lying on an electrostatically-chargeable conveyor belt and adhering thereto due to electrostatic forces and which transports the recording medium through said transfer printing region and along a guided transport section where it is conveyed to a fixing device;

said guided transport section being arranged in a transport unit and the fixing device being arranged in a fixing unit, said transport unit and fixing unit being used independent of one another and removable from the printing or copying device;

said fixing unit having at least one wall designed as a hollow chamber profile which hinders a heat transfer from the fixing unit to the transport unit;

the recording medium being conveyed to the fixing device along a free transport section in which the recording medium can freely arch; and a length of the free transport section being between 80 mm and 130 mm.

23. A system for transfer printing of an electrostatically charged toner image in an electrographic printing or copying device, comprising:

an intermediate carrier with an electrostatically charged toner image thereon which transfers the toner image onto a recording medium at a transfer printing region;

the recording medium lying on an electrostatically-chargeable conveyor belt and adhering thereto due to electrostatic forces and which transports the recording medium through said transfer printing region and along a guided transport section where it is conveyed to a fixing device;

said guided transport section being arranged in a transport unit and the fixing device being arranged in a fixing unit, said transport unit and fixing unit being used independent of one another and removable from the printing or copying device;

said fixing unit having at least one wall designed as a hollow chamber profile which hinders a heat transfer from the fixing unit to the transport unit; and at an end of the guided transport section, the transport band being guided around a roller that has a specific volume resistance of $10^7$ to $10^9$ Ω cm.

24. A system according to claim 23 in which the roller comprises silicon.

25. A system according to claim 23 in which the roller comprises a drive roller.

* * * * *